United States Patent [19]

Ettridge

[11] 4,086,039

[45] Apr. 25, 1978

[54] ORBITAL MACHINE WITH COOPERATING LOBE AND RECESS GUIDE MEANS

[76] Inventor: John P. Ettridge, 14 Somers St., North Brighton, South Australia, Australia, 5048

[21] Appl. No.: 737,041

[22] Filed: Oct. 29, 1976

[30] Foreign Application Priority Data

| | | |
|---|---|---|
| Nov. 4, 1975 | Australia | PC3835 |
| Dec. 22, 1975 | Australia | PC4363 |

[51] Int. Cl.[2] ..... F01C 1/02; F01C 19/04; F01C 21/06; F01C 21/12

[52] U.S. Cl. ..... 418/61 R; 418/64; 418/111; 418/148; 418/260; 418/266

[58] Field of Search ..... 418/61 R, 111, 146, 418/148, 260, 263, 266, 267, 63–67

[56] References Cited

U.S. PATENT DOCUMENTS

| | | | |
|---|---|---|---|
| 600,240 | 3/1898 | Stephens | 418/260 |
| 1,249,881 | 12/1917 | Anglada | 418/263 |
| 1,619,429 | 3/1927 | Maillefer | 418/146 |
| 1,770,225 | 7/1930 | Blackman | 418/148 |
| 1,914,622 | 6/1933 | Smith | 418/61 R |
| 1,969,651 | 8/1934 | Kretschmer | 418/61 R |
| 2,521,595 | 9/1950 | Miller | 418/111 |
| 3,966,365 | 6/1976 | Ulrich | 418/61 R |

FOREIGN PATENT DOCUMENTS

| | | | |
|---|---|---|---|
| 1,026,500 | 2/1953 | France | 418/61 R |
| 1,553,286 | 4/1970 | Germany | 418/266 |

*Primary Examiner*—John J. Vrablik

*Attorney, Agent, or Firm*—Oldham, Oldham, Hudak & Weber Co.

[57] ABSTRACT

A rotary machine operable as a pump, compressor, motor or internal combustion engine, the machine having a rotor orbiting but not rotating within a chamber in a housing, vanes separating the space within the chamber into working chambers. The rotor is eccentrically mounted on a rotatable shaft, the rotor being guided by lobes on the rotor operating in shaped recesses in the housing. The vanes are vane assemblies biassed outwardly into contact with the chamber wall, and include a plurality of vane blades to give a labyrinth seal effect.

3 Claims, 14 Drawing Figures

ORBITAL MACHINE WITH COOPERATING LOBE AND RECESS GUIDE MEANS

This invention relates to an improved rotary machine, and more particularly to a rotary machine having a rotor which orbits within a stationary housing.

BACKGROUND OF THE INVENTION

With machines having a rotor which orbits within a housing, it is necessary for the rotors movement to be adequately controlled during its orbiting motion, for the rotor can be mounted on a crank or the main shaft of the engine, and as there are vanes or the like dividing the space between the rotor and the stationary housing in order to form working chambers, these vanes must be maintained in relationship with any porting arrangements so that the ports, vanes and rotor form the working chambers having the correct timed relationship.

Thus for this to occur it is necessary that the rotor be adequately controlled, and one way of achieving this is to have a second crank shaft mounted in the housing and having the rotor also rotatable on this crank, but it is also essential with this that the two cranks be precisely connected to rotate in unison for if not the situation could occur that at the top dead-centre positions the cranks or one crank could tend to rotate in the opposite direction.

Australian Pat. No. 474,336 discloses an orbital machine when the rotor is controlled by a pair of crank shaft geared together, and it is an object of this invention to provide a means which will adequately restrain and control the movement of the rotor in its orbital motion and which means is simple and economical to produce and incorporate in the rotary machine.

SUMMARY OF THE INVENTION

Thus in one form of the invention there is provided a rotary machine having a rotor orbiting within a stationary housing, the rotor being mounted on at least one crank shaft and having additional means co-operating between the rotor and the stationary housing to control the movement of the rotor, said means comprising a plurality of circumferentially spaced members on the rotor or the housing to co-operate with a corresponding number of recesses on the housing or rotor so that a plurality of the members is engaged with a plurality of the recesses to control the relative movement of the rotor in the housing.

BRIEF DESCRIPTION OF THE DRAWINGS

In order to more fully describe the invention, reference will now be made to the accompanying drawings in which.

DESCRIPTION OF THE PREFERRED EMBODIMENT

Figure 1:
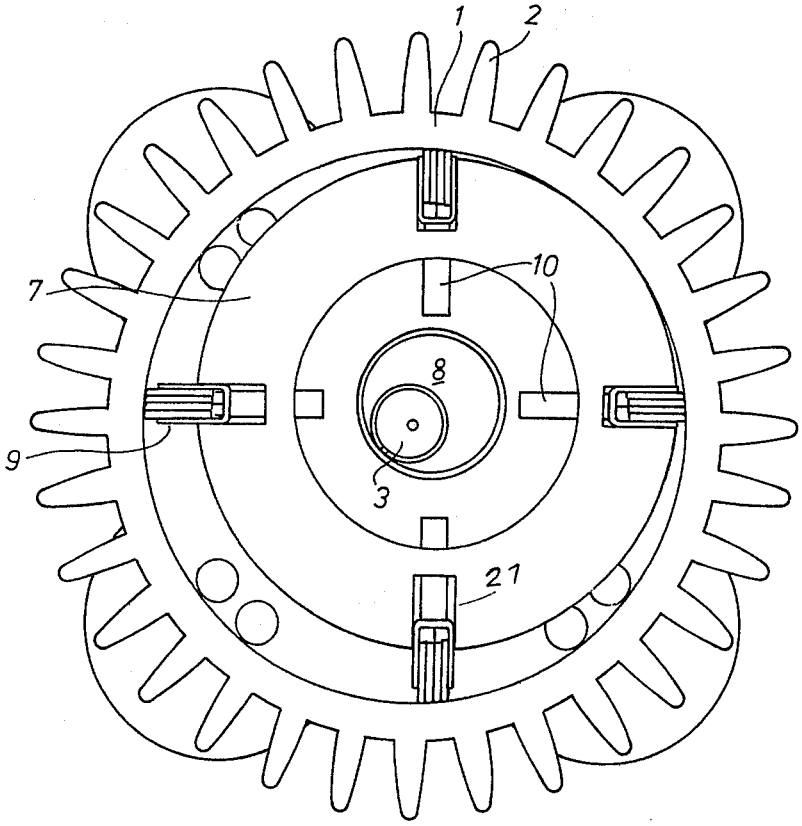
FIG. 1 is an end elevation of the machine with an end plate removed.
Figure 2:
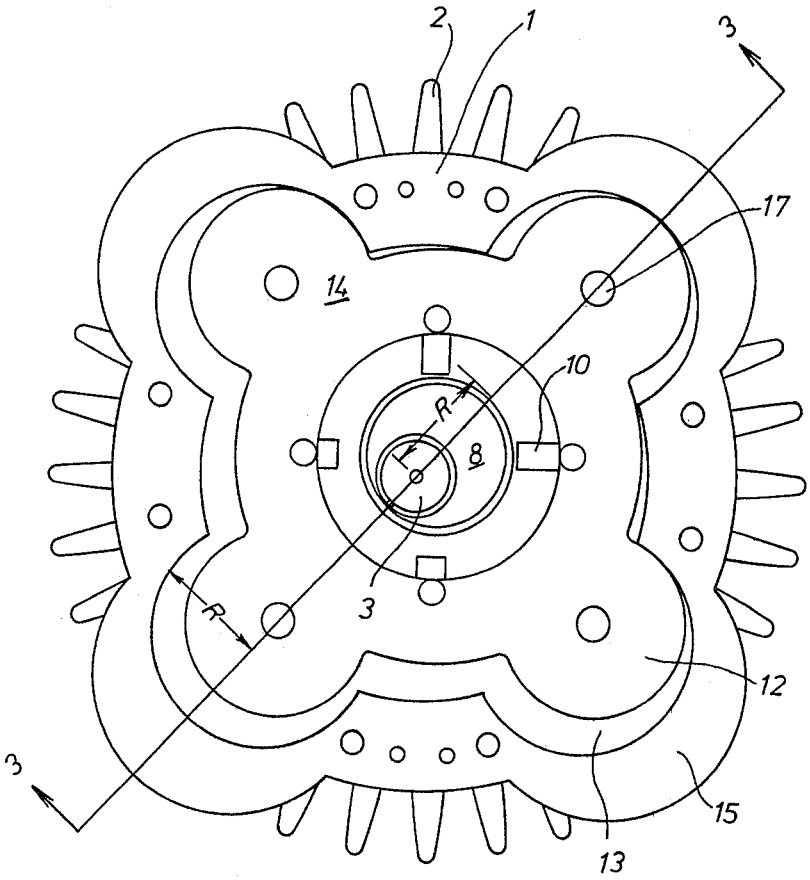
FIG. 2 is an end elevation of the machine from the opposite end with opposite end plate removed.

Referring to the drawings the machine comprises a cylindrical housing 1 having cooling fins 2. A shaft 3 is mounted in bearings 4 in side plates 5 and 6, the shaft being central of the circular working chamber in the housing 1.

A circular rotor 7 is mounted on a cam or crank 8 on the shaft 3, the rotor partaking of an orbital motion without rotation. Sealing vane assemblies 9 in this example 4 in number, are spaced around the rotor, the vane assemblies 9 being located outwardly against the inside of the housing by push rods 10 bearing on cam plates 11.

Figure 3:
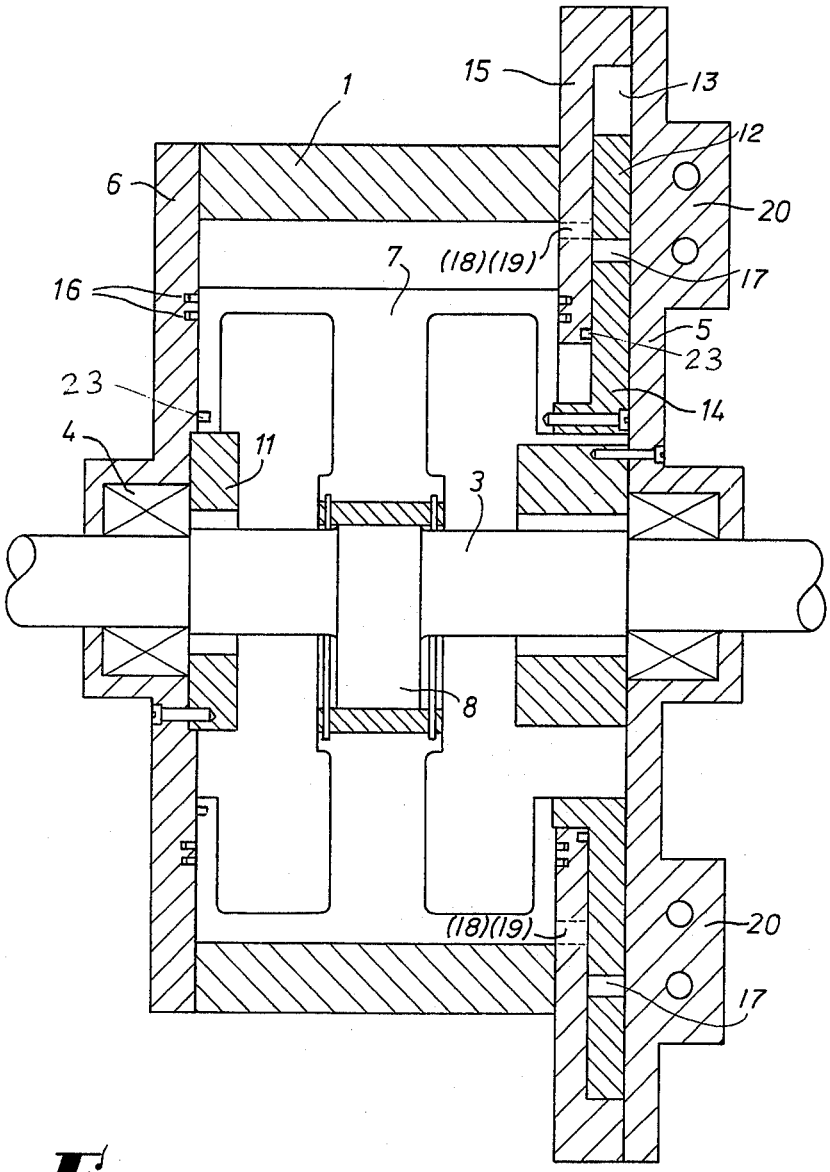
FIG. 3 is an inverted cross-section along the lines 3—3 of FIG. 2.

The rotor 7 is guided to partake of its orbital motion without rotation by lobes 12, situated in recesses 13, the lobes 12 being formed on a porting control plate 14 attached to, as by screws or studs, the rotor 7. The recesses 13 are formed in the housing 1, or as shown in FIG. 3 in a porting side plate 15.

Each of the lobes 12 will partake of an orbital movement in the recess, two of the lobes being in virtual contact with wall of its respective recess at any one time, so that the rotor 7 is restrained from rotation.

Sealing means 16 are provided on the side plate 6 and the porting side plate 15 to act on the side faces of the rotor 7, so that working chambers between each set of vane assemblies 9 are sealed between the vane assemblies 9 and the sealing means 16.

The side plate 5 overlies the porting control plate 14, and advantage is taken of the lobes working between the side plate 5 and porting side plate 15 to utilize this relative movement as a valve or porting control to control the flow of fluid into the chamber between the adjacent vanes.

Hence the porting control plate 14 is provided with a hole or port 17, and a pair of spaced holes 18, 19 are formed in the porting side plate 15.

The side plate 5 has ports similarly positioned to the ports 18 and 19, and hence the port 17 in the porting control plate 14 serves to interconnect the respective ports 18 meaning the side plate 5 and porting side plate 15, or the ports 19 in the side plate 5 and porting side plate 15.

Figure 4:
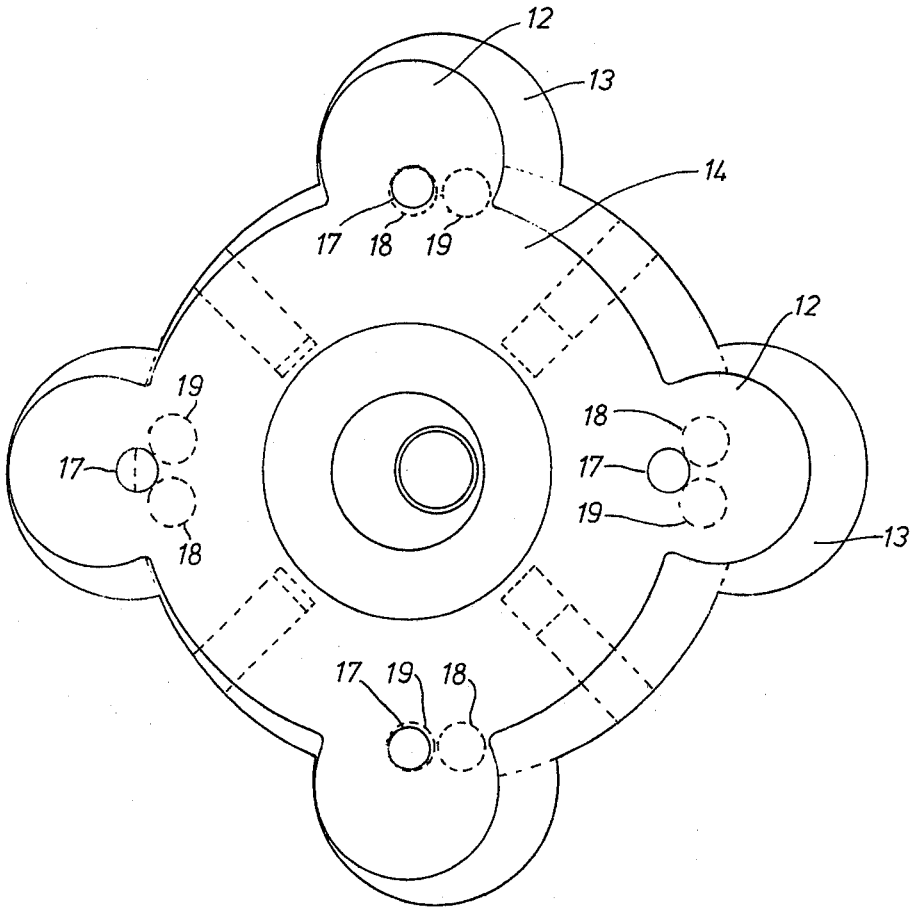
FIG. 4 is an end elevation similar to FIG. 1 but in diagrammatic form to illustrate the porting control.
Figure 5A:
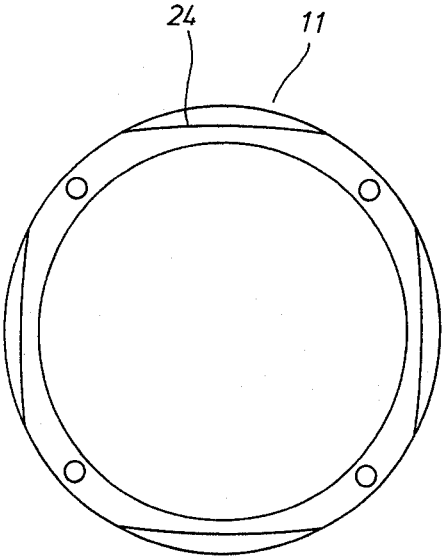
FIGS. 5A and 5B are end and side elevations of a cam plate to control the vane movements.
Figure 5B:
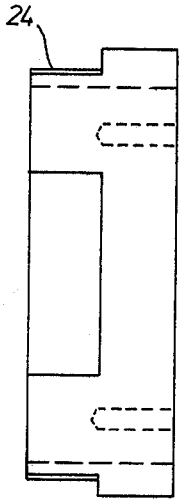
Figure 6:
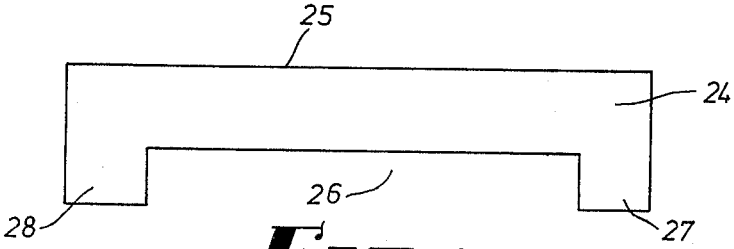
FIG. 6 is a side view of a vane assembly.

Thus it will be seen that by reference to FIG. 4, that assuming that the rotor orbits clockwise, the lobes on the left hand side could be considered as at top dead centre while the lobes on the right hand side are considered to be at bottom dead centre. As the rotor orbits, the port 17 will uncover the port 18 to allow fluid to enter as the chamber increases in volume until the chamber is at its maximum volume by which time the port 17 will have virtually passed over port 18, and will start to uncover port 19 to allow the rotor to force the fluid out of the port 19 as the rotor orbits.

Hence as described, the machine acts as a compressor with the ports 18 being the inlet ports and the ports 19 the outlet ports. It will also be seen that the machine could act as a fluid motor, or a two-stroke internal combustion motor with one chamber changing the following chamber. By utilizing two such machines, one machine can act as a two-stroke internal combustion engine with the other machine acting as a super charger to deliver the combustible mixture to the appropriate chamber in a two-stroke manner.

The side plate 5 can include appropriate manifolding 20 to connect the respective inlet and outlet ports to be connected to a common inlet and outlet (not shown).

While the ports 17, 18 and 19 have been shown as circular, it is realised that they can be of other shapes or combinations of shapes, to achieve the desired flow of fluid. Hence the ports can be elongated so that there is a longer time where the ports are fully open to give a greater flow, and the ports can be shaped to give a quicker cut-off or opening as desired.

Figure 11:
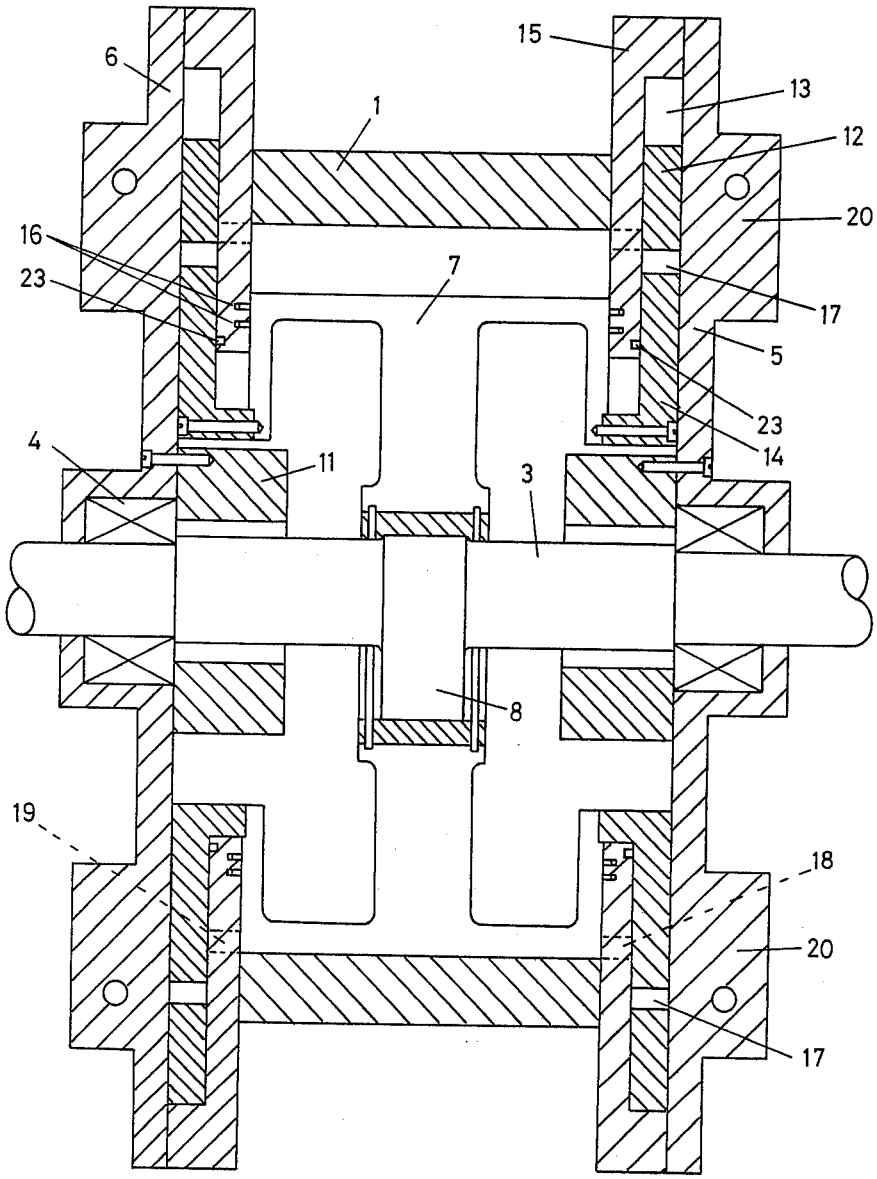
FIG. 11 shows a section, like FIG. 3, of an alternative machine with lobes and recesses at each end of the housing.

The machine as above described has a porting control plate at one side only, but it is to be realised that the porting control plate with respective lobes and recesses can be provided at each side of the machine. As shown in FIG. 11, one porting control plate could be utilized as the inlet ports and the other plate the outlet ports, and hence a cross-flow of fluid through the machine can be achieved. If an internal combustion engine is provided by the machine, then the cross flow arrangement will assist in scavenging the exhaust gases.

Figure 7A:
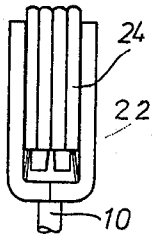
FIGS. 7A and 7B are end views of alternate assemblies of vanes.

The vane assemblies 9 are mounted in slots 21 in the rotor, each assembly referring to FIG. 7A, including a U-shaped holder 22, the holder 22 being in two halves and bearing on two pins or push rods 10. The push rods 10 extend radially through holes in the rotor and engage the cam plate 11, the surface 24 of the cam plate being formed with a curved surface having a radius equal to the radius of the surface of the interior of the housing, so that the vane assemblies are maintained in contact with the interior surface of the housing.

Each vane assembly 9 includes four blades 24, and each blade is formed with a sealing surface 25 and a cut-out 26 opposite the sealing surface 25. The blade 24 thus has two legs 27 and 28, the leg 28 being of greater width than the leg 27, this difference in width being preferably in the order of 1.60 mmls. Each of the four blades 24 is formed in this manner, but they are assembled with each second blade being reversed. A spring 29 which is inserted into the cut-out then acts on the legs to bias each leg in opposite directions, so that the seals which then bear on the side plate 6 and porting side plate 15 form a type of labyrinth seal therebetween. The spring 29 is preferably of channel shape with end portions 30 to bear against the inside edges of the legs 27 and 28 of the blades 24, the sides of the spring 29 also being resilient and the spring is inserted into the U-shaped holder 22. One or more springs 31 are then inserted above the spring 29 to bias the blades radially outwardly, and the blades 24 are then fitted into the holder 22. Thus the spring 29 will force alternate blades in opposite directions and the spring or springs 31 would bias the blades outwardly.

Figure 7B:
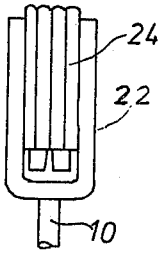
Figure 8:
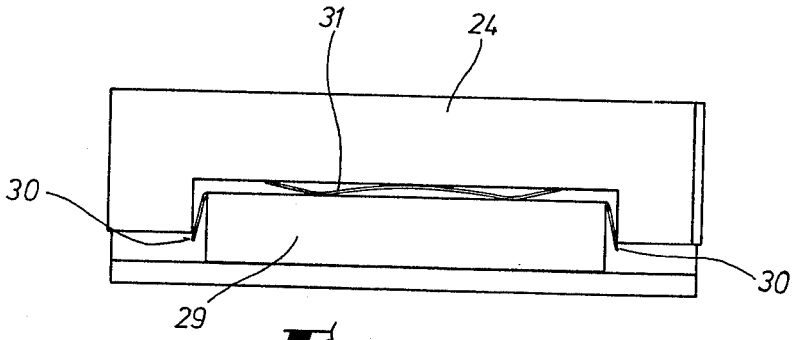
FIG. 8 is a cross-section of the vane assembly showing the spring arrangement.
Figure 9A:
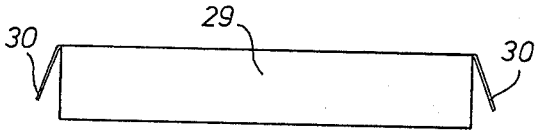
FIGS. 9A and 9B show the side and end elevation of a spring.
Figure 9B:
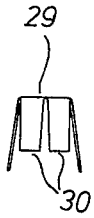
Figure 10:
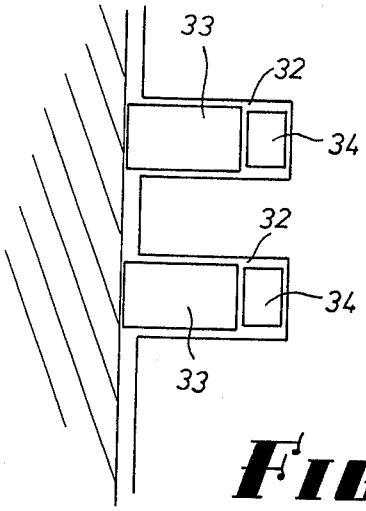
FIG. 10 shows in magnified form the end sealing rings in the end plates.

Referring to FIG. 7B, the blade holder 22 is formed as an integral U-shaped holder with a solid insert portion in place of the spring 29. The springs 31, in this instance can extend across the length of the insert portion and extend also along each end, so that the springs 31 force the blades radially outwardly and also axially of the blade holder 22. The rod 10 is fixedly secured to the blade holder by being welded to the base thereof, or by being fitted into a recess in the holder and/or insert.

By the provision of the push rod 10 on the blade holder 22, the blade holder is held to move purely radially, and in this way the slots in the rotor can be held to a minimum, and even if the vane assembly protrudes outwardly of the slot to a large extent, there is no tendency for the blade assembly to tilt.

It will be realised that the blades 24 instead of being U-shaped may be L-shaped with one leg only, and by being alternatively placed, the spring 29 would bias each adjacent blade in an opposite direction.

In order to seal the end faces of the rotor itself against the side plate 6 and the porting side plate, the sealing means 16 can comprise circular groove or grooves 32 into which a circular split sealing ring 33 is inserted, the rings 33 being biassed outwardly by a spring 34, this preferably being a wave spring which is formed in a circular manner and applies its bias around the circumference of the ring 33.

The cam plate 11 can be formed integrally with its respective side plate, or alternatively may be screwed or attached thereto as by studs, the plates being hollow to allow the shaft to pass therethrough.

Oil control seals 23 are provided in the end face of the rotor, and in the plate 15, to control the flow of oil from the lubrication oil supplied to the centre of the rotor to lubricate the bearings and crank.

In order to satisfactorily seal around the ports in the lobes of the porting control plate, a sleeve (not shown) could be provided around each port in the side plate 5, this sleeve being biassed by a spring against the porting control plate 14, so that the sleeves seal around the ports.

In a further alternative, the lobes may be formed with a protruding portion to be fitted with a ball race or the like so that the outer race of the bearing would roll round the recess to further eliminate friction.

While two complete embodiments of the invention have been disclosed herein, it will be appreciated that modification of these particular embodiments of the invention may be resorted to without departing from the scope of the invention.

I claim:

1. A rotary machine including a housing, a chamber within the housing, a shaft concentric with the chamber and having eccentrically mounted thereon a rotor, a plurality of vanes dividing the space between the rotor and inner wall of the chamber into working chambers and valve means to control flow of fluid through said working chambers, the rotor being guided to partake of an orbital movement within the chamber by a plurality of cooperating lobes and recesses on the rotor and the housing whereby the rotor is prevented from rotation while partaking of its orbital movement characterized in that the lobes are formed on a plate attached at one end of the rotor, and the recesses are formed in a porting side plate forming a side wall of the chamber, a port in said lobe cooperating with ports in said porting side plate to form the valve means.

2. A rotary machine as defined in claim 1 wherein the lobes and recesses comprise two sets, one set of lobes and recesses being at one side of the housing and the other set being at the opposite side of the housing; the lobes being formed on extensions of the rotor and the recesses in the housing.

3. A rotary machine as defined in claim 2 characterized in that the lobes are formed on an extension of the rotor, and the recesses are formed in the housing, the lobes and recesses each being four in number with the recesses being part circular and having a radius equal to the radius of the crank forming the eccentricity of the rotor on the shaft.

* * * * *